US005234738A

United States Patent [19]

Wolf

[11] Patent Number: 5,234,738

[45] Date of Patent: Aug. 10, 1993

[54] RESILIENT TILE FOR RECREATION SURFACES

[75] Inventor: Tom H. Wolf, Carlisle, Pa.

[73] Assignee: Carlisle Tire & Rubber Company, Carlisle, Pa.

[21] Appl. No.: 741,139

[22] Filed: Aug. 7, 1991

[51] Int. Cl.[5] ..... B32B 3/30

[52] U.S. Cl. ..... 428/120; 428/44; 428/119; 428/218; 52/177; 404/32; 404/35

[58] Field of Search ..... 428/44, 119, 120, 218; 52/177; 404/32, 35; 5/417, 420

[56] References Cited

U.S. PATENT DOCUMENTS 3,699,926 10/1972 Stockl ..... 52/177
4,287,693 9/1981 Collette ..... 52/177
4,727,697 3/1988 Vaux ..... 52/177
4,848,058 7/1989 Mullen ..... 52/585
4,921,741 5/1990 Mullen ..... 428/48
4,930,286 6/1990 Kotler ..... 52/177
4,948,116 8/1990 Vaux ..... 52/177

*Primary Examiner*—Alexander S. Thomas
*Attorney, Agent, or Firm*—Wood, Herron & Evans

[57] ABSTRACT

Resilient tiles having substantially uniform impact attenuation over the entire surface thereof are disclosed. The tiles of the invention have a plurality of spaced, elongated peripheral ridges and a plurality of truncated, conical legs inboard of the peripheral ridges which combine to provide the substantially uniform impact attenuation of the tiles.

11 Claims, 2 Drawing Sheets

RESILIENT TILE FOR RECREATION SURFACES

FIELD OF THE INVENTION

The present invention relates to resilient, impact-absorbing tiles for recreational surfaces, such as playgrounds, and more particularly to an impact-absorbing tile configuration having substantially uniform shock attenuation characteristics over its entire surface area, as well as improved resistance to removal when adhered to a support surface.

BACKGROUND OF THE INVENTION

In recent years there has been increasing concern with reducing injuries that occur when children fall from playground equipment and strike the underlying surface. Hard surfacing materials such as asphalt and concrete do not provide adequate injury protection from falls and are therefore generally unsuitable for use under and around playground equipment. Other surfacing materials commonly used around playground equipment are wood chips, bark chips and sand. These particulate materials require continuous maintenance and their cushioning potential depends upon the air trapped within and between the individual particles. Thus, as the materials decompose or become pulverized over a period of time, they tend to lose their cushioning effect. In the case of sand, moisture tends to increase the cohesiveness of the sand and therefore reduce its cushioning effect.

One proposed solution to the aforementioned problems is to construct a recreation surface using a plurality of tiles made of rubber crumbs bound together with a suitable binding material and molded into generally square tiles. U.S. Pat. Nos. 4,848,058 and 4,921,741 disclose such tiles and means for interlocking and fastening the tiles, respectively. An array of the bonded rubber crumb (BRC) tiles possesses desirable shock attenuation characteristics. The tiles disclosed in the aforementioned patents may have a solid parallelepiped structure, or they may have "dimples" in the bottom surface thereof or "cores" extending transversely through the body of the tile to enhance the shock attenuation characteristic of the tile. Tiles having these various configurations may present certain manufacturing difficulties.

One known BRC-type tile has an upper tile region of uniform thickness from which extend downwardly a plurality of legs of substantially square cross-section throughout their length. The tile, at its perimeter, has a plurality of perimeter legs which have a smaller cross-sectional area than the legs in the central region, with the exception of L-shaped perimeter legs located at the corners of the tile. Although these prior art BRC tiles provide significant improvements over other known prior art BRC tiles, their shock attenuation characteristics are not ideal, and their resistance to removal when adhered to an underlying support surface leaves room for improvement.

SUMMARY OF THE INVENTION

The present invention is directed to resilient bonded rubber crumb tiles which possess improved, substantially uniform shock absorbency or shock attenuation characteristics over the entire surface area of the tiles. Additionally, the tiles require a reduced amount of material thereby lowering the cost of production and subsequent shipping. Furthermore, due to the configuration of the tiles of the present invention, the tiles have improved resistance to removal when adhered to an underlying support surface.

In a preferred embodiment, the tiles of the present invention include an upper parallelepiped tile region having a lower surface which consists of a peripheral region and a central region. The peripheral region contains a plurality of peripheral ridges integral with and extending downwardly from the lower surface of the upper tile region. The central region contains a plurality of truncated conical legs integral with and extending downwardly from the lower surface of the upper tile region inboard of the peripheral ridges. Preferably, all of the conical legs and the peripheral ridges are of uniform height. Furthermore, the peripheral ridges are preferably spaced slightly inwardly from the periphery of the upper tile region so as to define an expansion lip which deforms during periods of expansion to prevent buckling of the entire recreation surface when a plurality of tiles are arranged in an array.

The tiles of the present invention embody certain structural and physical characteristics which cooperate to provide the unique advantages of the tiles, including substantially uniform shock attenuation over the entire surface area thereof and improved removal-resistance. These structural and physical characteristics include the ratio of the height of the conical legs to the thickness of the upper parallelepiped tile region, the concentration of conical legs in the central region, the adhesive contact surface area of the legs and peripheral ridges, the density of the tile, and the draft of the conical legs and the inner side of the peripheral ridges. Specific preferred values and ranges for the above parameters have been determined to provide improved uniformity in shock absorbency, enhanced resistance to removal, and simplified manufacturing of the tiles of the present invention.

The details of these parameters will be discussed more fully below and various other features and advantages of the present invention will become apparent to persons skilled in the art upon reading the more detailed description of the invention which follows.

DETAILED DESCRIPTION OF THE INVENTION

Figure 1:
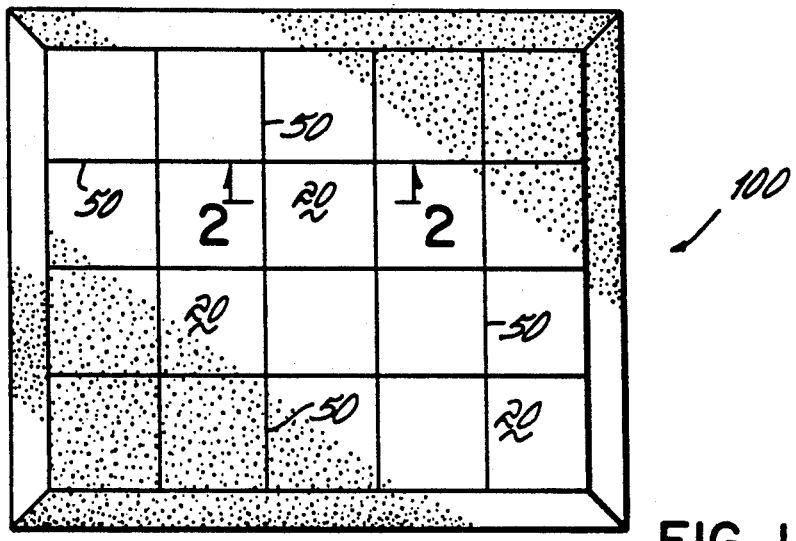
FIG. 1 is top plan view of an array of tiles of the present invention.

The resilient tiles of the present invention may be used advantageously in an array 100 as shown in FIG. 1 to provide the underlying surface beneath and/or around playground equipment (not shown) or for other recreational surface uses. The array of individual tiles 20 shown in FIG. 1 may be interlocked and secured to the underlying surface in various ways, including those described in U.S. Pat. Nos. 4,848,058 and 4,921,741, the disclosures of which are fully incorporated herein by reference.

Figure 4:
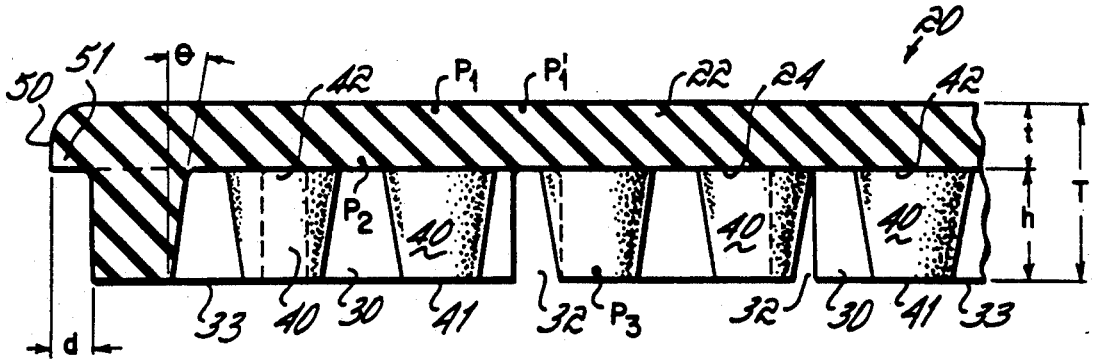
FIG. 4 is a cross-section of an alternative embodiment of the tile of the present invention.
Figure 5:
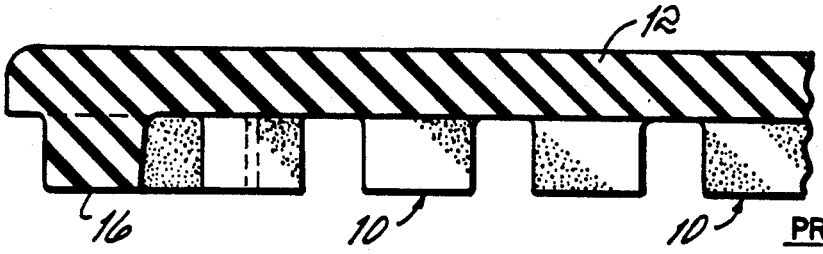
PRIOR ART FIG. 5
FIG. 5 is a cross-section, partially broken away, of a prior art tile.
Figure 6:
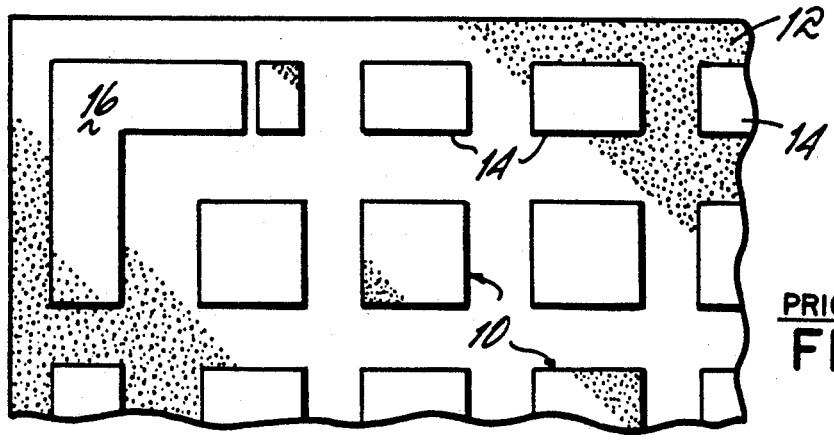
PRIOR ART FIG. 6
FIG. 6 is a bottom plan view, partially broken away, of the tile shown in FIG. 5.

The resilient tiles of the present invention are shown in FIGS. 1–4, and an example of a prior art tile is shown in FIGS. 5 and 6. The prior art tile has legs 10 of substantially square cross-section throughout their length which extend downwardly from an upper tile region 12. This tile also has a plurality of perimeter legs 14 at its perimeter which have a smaller cross-sectional area than legs 10, with the exception of L-shaped perimeter legs 16 located at the corners of the tile.

Figure 2:
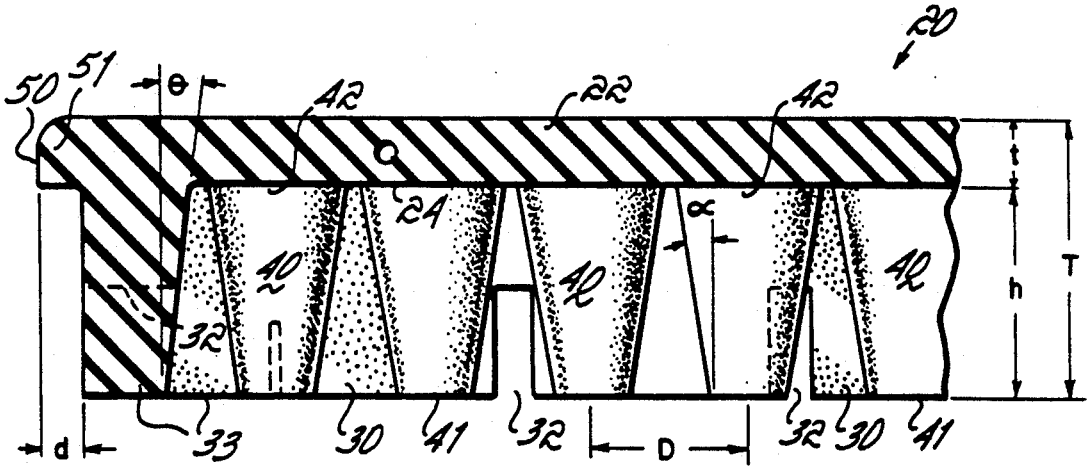
FIG. 2 is a cross-section taken along line 2—2 of FIG. 1 showing one embodiment of the tile of the present invention.

It will be appreciated that the tiles of the present invention may be manufactured in various sizes, and FIGS. 2 and 4 show tiles having different overall thicknesses T. Generally speaking, however, regardless of the overall tile thickness, the tiles of the present invention possess the same structural elements and physical characteristics to ensure the desired uniform shock attenuation.

Figure 3:
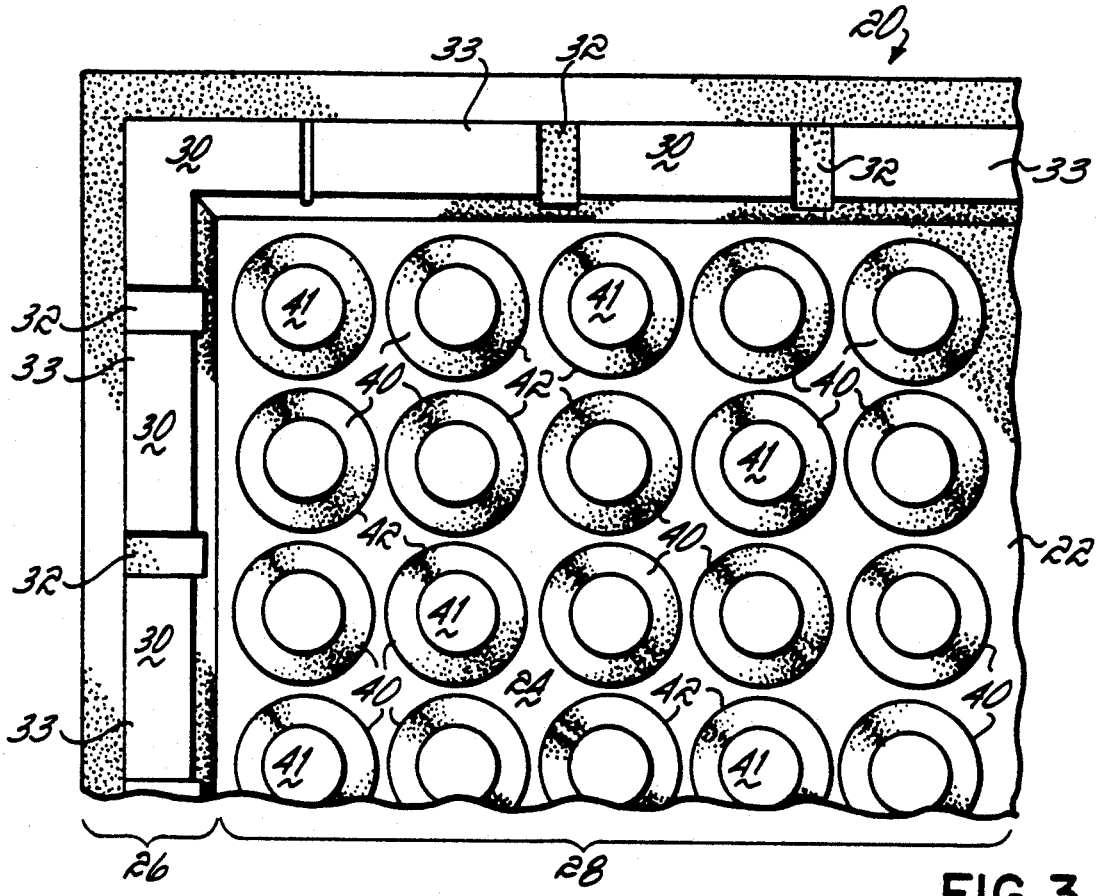
FIG. 3 is a bottom plan view, partially broken away, of the tile shown in FIG. 2.

Each tile 20 consists of an upper tile region 22 in the form of a rectangular parallelepiped which has a thickness t as measured in the vertical direction (see FIGS. 3 and 4), and a lower surface 24 which consists of a peripheral region 26 and a central region 28 (see FIG. 3). Peripheral region 26 includes a plurality of peripheral, generally rectangular ridges 30 formed integral with and extending downwardly from lower surface 24 of upper tile region 22. Ridges 30 are provided in peripheral region 26 to reduce edge deflection of tiles 20, which are unsupported at their periphery by adjacent tiles. Ridges 30 thus serve to aid in achieving substantially uniform shock attenuation over the entire surface of the tiles. Ridges 30 are preferably spaced inwardly from the edge 50 of upper tile region 22 a distance d, thereby defining a peripheral expansion lip 51. Expansion lip 51 allows each tile 20 to consume its unit expansion without transmitting the expansion to adjacent tiles. This serves to prevent buckling in an array of tiles.

Elongated ridges 30 preferably have notches 32 formed therein in the molding process. In the embodiment shown in FIG. 2, notches 32 do not extend to the full height h of ridges 30, whereas in the embodiment shown in FIG. 4, notches 32 do extend to the full height h of ridges 30. The reason for this difference is that more edge support is required for thicker tiles. Thus, in the thicker tile embodiment shown in FIG. 2, notches 32 do not extend the full height h of ridges 30, whereas they do in the relatively thinner tile shown in FIG. 4. Notches 30 also assist in the drainage of water from beneath a recreation surface comprised of an array of tiles 20. Finally, elongated ridges 30 preferably have a slightly tapered inwardly facing edge 31 which has a draft $\theta$ on the order of approximately 7° (see FIGS. 2 and 4). This draft enhances filling the mold utilized in the production of the tiles and results in more uniform density of ridges 30.

Central region 28 of tile 20 includes a plurality of truncated conical legs 40 formed integral with and extending downwardly from lower surface 24 of upper tile region 22. In a preferred embodiment of the present invention, legs 40 preferably have a draft $\alpha$ in the range of about 5–15° and preferably about 9° (see FIG. 2). Furthermore, conical legs 40 are preferably spaced with a center-to-center distance D of approximately $1\frac{7}{8}$". To ensure a substantially uniform, desired shock attenuation value, it is important that the bases 42 of conical legs 40 do not intersect one another at or adjacent lower surface 24 of upper tile region 22. Additionally, the concentration of conical legs 40 in central region 28 is preferably in the range of about 35–45 legs/ft$^2$, and more preferably about 40 legs/ft$^2$. If there are too few legs, the tiles will be too "soft" and difficult to walk on. If there are too many legs, the bases 42 thereof will intersect, thereby reducing the impact attenuation of the tiles and requiring additional material.

Each leg 40 has a bottom surface 41, and each ridge 30 has a bottom surface 33, which are the contact surfaces for adhering the tiles, with a suitable adhesive, such as VERSASEAL sold by Carlisle Tire & Rubber Company, to the underlying surface. The total leg contact area, which is the sum of the contact surface areas of each individual leg 40, for adhering the central region of the tile to an underlying surface is preferably in the range of 15%–30% of the total area of central region 28. It has been determined that where the total contact area is below about 15%, adhesive failure may occur; i.e., there is insufficient contact surface area to satisfactorily adhere the tiles to the underlying surface. It has also been determined that where the total contact area is greater than about 30%, cohesive failure may occur; i.e., attempts to remove an adhered tile from the underlying surface result in tearing the conical legs 40. The total ridge contact area, which is the sum of the contact surface areas of each individual ridge 30, is preferably in the range of about 25%–40% of the total area of peripheral region 26, and more preferably is about 36% of that total area.

As mentioned previously, the present invention contemplates tiles of various thicknesses T which embody the inventive features of the present invention. Tiles having an overall thickness T of $1\frac{3}{4}$", 2" and $3\frac{1}{4}$" have been tested. In these tiles, it has been determined that the ratio of the leg and ridge height h to the upper tile thickness t, that is, the ratio "h:t," should preferably be in the range of 1.33:1–3.33:1, depending on the overall tile thickness T. More particularly, it has been found that the preferred h:t ratios for tile thickness (T) of $1\frac{3}{4}$", 2", and $3\frac{1}{4}$" are 1.33, 1.66, and 3.33, respectively. This ratio of leg height to upper tile thickness (h:t) is important in achieving the desired impact attenuation values for the tiles of the present invention because if the upper tile region 22 is too thick the tile will be too dense and impact attenuation will be decreased. Furthermore, thicker tiles require more material, which adds to the tile manufacturing cost.

The final parameter which affects impact attenuation in the tiles of the present invention is the density at various locations in the tile. It is preferable to maintain substantially uniform maximum density at the upper surface 21 of upper tile region 22 to improve the wear resistance of the tile, improve the scrubability of the tile and provide more positive footing. Since the tiles of the present invention are formed by a compression molding technique (described in detail below), the density tends to be the greatest adjacent the upper surface 21 of upper tile region 22. Density is somewhat lower adjacent the lower surface 24 of upper tile region 22, and lowest at a location adjacent the bottom surface 41 of conical legs 40 and bottom surfaces 33 of ridges 30.

More particularly, with specific reference to FIG. 4, tile 20 preferably has a density in the range of about 850–900 kg/m$^3$ adjacent upper surface 21 of upper tile region 22. Slight variations in the tile density adjacent upper surface 21 across the surface of the tile is due to the fact that there is more vertical compression of upper tile region 22 at locations designated $P_1'$, below which (vertically) there are no conical legs 40. Locations designated $P_1$, below which (vertically) there are conical legs 40 or ridges 30, may have a slightly lower density than locations $P_1'$. The density of tile 20 adjacent lower surface 24 of upper tile region 22 is preferably about 750 kg/m$^3$ at points $P_2$. Finally, the density at points $P_3$ which are adjacent bottom surfaces 41 of conical legs 40 is preferably about 550 kg/m$^3$. The lower the density at the bottom of the conical legs, the higher will be the shock attenuation of the tile, but sufficiently high density is necessary to maintain the cohesiveness of the tile legs during removal from the mold and after adhesion to an underlying surface.

The tiles of the present invention are manufactured in accordance with conventional compression molding principles. The materials used in the production of the tiles are rubber crumb particles, which may be recycled ground tire rubber. The size of the crumbs used is preferably in the range of about ⅜"-30 mesh screen, and mixtures of various crumb sizes may be used. A suitable urethane binder composition is utilized to bind the rubber crumbs together. Preferably, the binder materials is a two component urethane system which reacts and cures when mixed and heated. For example, the two components may be MDI (diphenyl methane diisocyanate) and polyether polyol. The binder composition may comprise 50–70% of the polyol component and 30–50% of the isocyanate component, and preferably comprises 55% polyol and 45% isocyanate. If desired, one of the urethane components may contain color pigmentation to color the tiles.

In a preferred production method, crumb particles are initially weighed in a holding bin and then fed into a high speed mixing chamber to blend the mixture for approximately one minute. Thereafter, the first urethane component and/or the first urethane component plus color pigmentation is added to the rubber crumb mixture and blend mixing is continued for between about 1–5 minutes. This rubber crumb/urethane mixture, known as the "primary", may be held statically in the mixer until the molding mixture is needed, at which time the blend mixer is activated and the second urethane component is added and blend mixed with the primary mix for approximately 1–3 minutes to form the molding mixture. The molding mixture is then dropped onto a weigh scale. Thereafter, a heated mold form, which is configured to produce tiles having the structure and dimensions discussed above, is positioned under the weigh scale and a specified weight of the molding mixture is poured into the mold form. The mixture is distributed across the heated mold form by conventional mechanical means such as a rake and a mold lid is placed on the mold form. The lid and mold form are placed under a pneumatic press and compressed; the lid is secured to the mold by a mold latch system to maintain the molding mixture under compression. Subsequently, the filled mold form is transported to an external heat source, such as an infra-red oven, and heated to a temperature of between about 150°–250° F. so that the first and second urethane components react and cure to form the desired bonded rubber crumb composite tile with the desired density values discussed previously.

It will be appreciated that various types of mixers and heat sources and various binder materials can be employed in the production of the tiles of the present invention and that mixing times and heating temperatures will vary according to the specific equipment and materials used.

In a preferred embodiment, the tiles contain between about 5%–25% (by weight) urethane binder and between about 95%–75% (by weight) rubber crumb particles. The percent molding compression, which is defined as the finished product thickness divided by the non-compressed molding mixture depth, is preferably between about 20%–60%.

It will be appreciated by persons skilled in the art that various modifications can be made to the present invention which are within the scope of the invention as defined by the appended claims.

What is claimed is:

1. A resilient tile having improved, uniform shock absorbency, comprising:

an upper tile region having upper and lower surfaces and a substantially uniform thickness as measured in the vertical direction;

a plurality of spaced ridges integral with and extending downwardly from said lower surface of said upper tile region at the periphery thereof, said ridges each having a bottom surface; and a plurality of truncated, conical legs integral with and extending downwardly from said lower surface of said upper tile region inboard of said spaced, peripheral ridges, said legs each having a bottom surface;

all of said conical legs and said peripheral ridges having a substantially uniform height, the ratio of said height to said upper tile region thickness being in the range of about 1.33:1 to 3.33:1;

said tile having a concentration of conical legs in the range of about 34–45 legs/ft$^2$, and said tile having a density at a location adjacent said upper surface of said upper tile region in the range of about 850–900 kg/m$^3$, a density at a location adjacent said lower surface of said upper tile region of about 750 kg/m$^3$, and a density at a location adjacent said bottom surface of any one of said conical legs of about 550 kg/m$^3$.

2. The tile of claim 1 wherein said conical legs are spaced with a center-to-center distance of approximately 1⅞".

3. The tile of claim 1 wherein the overall thickness T of said tile is in the range of about 1¾"–3¼".

4. The tile of claim 1, wherein said lower surface of said upper tile region comprises a peripheral region containing said peripheral ridges and a central region containing said conical legs, said bottom surfaces of said peripheral ridges having a combined surface area in the range of about 25–40% of the total surface area of said peripheral region, and said bottom surfaces of said conical legs having a combined surface area in the range of about 15–30% of the total surface area of said central region.

5. The tile of claim 4 wherein said truncated, conical legs have a draft in the range of about 5°–15°.

6. The tile of claim 5 wherein said conical leg draft is about 9°, and said peripheral ridges have an inwardly-facing surface having a draft of about 7°.

7. A resilient tile having improved, uniform shock absorbency, comprising:

an upper tile region having upper and lower surfaces and a substantially uniform thickness as measured in the vertical direction, said lower surface of said upper tile region comprising a peripheral region and a central region;

a plurality of spaced ridges integral with and extending downwardly from said lower surface of said upper tile region in said peripheral region, said ridges each having a bottom surface; and a plurality of truncated, conical legs integral with and extending downwardly from said lower surface of said upper tile region in said central region, said legs each having a bottom surface and said legs spaced with a center-to-center distance of approximately $1\frac{7}{8}''$;

all of said conical legs and said peripheral ridges having a substantially uniform height and the ratio of said conical leg height to said upper tile region thickness in the range of about 1:33:1 to 3.33:1;

said tile having a concentration of conical legs in the range of about 35–45 legs/ft$^2$, said tile having a density at a location adjacent upper surface of said upper tile region in the range of about 850–900 kg/m$^3$, a density at a location adjacent said lower surface of said upper tile region of about 750 kg/m$^3$, and a density at a location adjacent said bottom surface of any one of said conical legs of about 550 kg/m$^3$.

8. The tile of claim 7 wherein said bottom surfaces of said peripheral ridges have a combined surface area in the range of about 25–40% of the total surface area of said peripheral region and said bottom surfaces of said conical legs having a combined surface area in the range of about 15–30% of the total surface area of said central region.

9. The tile of claim 7 wherein said truncated, conical legs have a draft in the range of about 5°–15°.

10. The tile of claim 9 wherein said conical leg draft is about 9°, and said peripheral ridges have an inwardly-facing surface having a draft of about 7°.

11. The tile of claim 7 wherein the overall thickness T of said tile is in the range of about $1\frac{3}{4}''$–$3\frac{1}{4}''$.

* * * * *

UNITED STATES PATENT AND TRADEMARK OFFICE

CERTIFICATE OF CORRECTION

PATENT NO. : 5,234,738

DATED : August 10, 1993

INVENTOR(S) : Tom H. Wolf

It is certified that error appears in the above-indentified patent and that said Letters Patent is hereby corrected as shown below:

In column 7, line 14, "1:33:1" should be --1.33:1--.

Signed and Sealed this

Seventh Day of June, 1994

*Attest:*

*Attesting Officer*

BRUCE LEHMAN

*Commissioner of Patents and Trademarks*